US005875750A

United States Patent [19]

Iwasaki et al.

[11] Patent Number: 5,875,750

[45] Date of Patent: Mar. 2, 1999

[54] ROTATIONAL PHASE ADJUSTING APPARATUS RESIN SEAL

[75] Inventors: Kazutoshi Iwasaki, Nagoya; Hiroyuki Yamazaki, Hazu-gun; Michio Adachi, Obu; Masayasu Ushida, Okazaki; Hisashi Kayano, Toyoake; Isamu Inai, Chita-gun, all of Japan

[73] Assignee: Denso Corporation, Kariya, Japan

[21] Appl. No.: 928,258

[22] Filed: Sep. 12, 1997

[30] Foreign Application Priority Data

Sep. 13, 1996 [JP] Japan ..... 8-242961

[51] Int. Cl.[6] ..... F01L 1/344

[52] U.S. Cl. ..... 123/90.17; 123/90.31; 123/90.37; 74/568 R; 464/2; 464/160

[58] Field of Search ..... 123/90.15, 90.17, 123/90.31, 90.37; 251/214; 74/568 R; 464/1, 2, 160

[56] References Cited

U.S. PATENT DOCUMENTS

| | | | |
|---|---|---|---|
| 4,858,572 | 8/1989 | Eiji et al. | 123/90.15 |
| 5,107,804 | 4/1992 | Becker et al. | 123/90.17 |
| 5,205,249 | 4/1993 | Markley et al. | 123/90.17 |
| 5,361,735 | 11/1994 | Butterfield et al. | 123/90.17 |
| 5,450,825 | 9/1995 | Geyer et al. | 123/90.17 |
| 5,666,914 | 9/1997 | Ushida et al. | 123/90.17 |
| 5,727,508 | 3/1998 | Goppelt | 123/90.17 |

FOREIGN PATENT DOCUMENTS

U-2-50105 4/1990 Japan .

*Primary Examiner*—Wellun Lo
*Attorney, Agent, or Firm*—Nixon & Vanderhye P.C.

[57] ABSTRACT

In a rotational phase adjusting apparatus which may be used for controlling opening/closing timings of intake and exhaust valves of an internal combustion engine, one side wall of a housing is fixed to one of a driving member and a driven member, while the other side wall of the housing is made integrally with a circumferential wall of the housing. A seal made of a material less harder than the housing is provided between the housing and a vane. The housing is made of an aluminum while the seal is made of a PPS resin mixed with an inorganic filler. The inorganic filler is harder than the PPS resin but less harder than the housing to reduce wear of the housing.

11 Claims, 6 Drawing Sheets

ROTATIONAL PHASE ADJUSTING APPARATUS RESIN SEAL

CROSS REFERENCE TO RELATED APPLICATION

This application is related to and incorporates herein by reference Japanese Patent Applications No. 8-242961 filed on Sep. 13, 1996 and No. 9-211776 filed on Aug. 6, 1997.

BACKGROUND OF THE INVENTION

1. Field of the Invention

The present invention relates to a rotational phase adjusting apparatus used for, for example, valve timing adjustment which adjusts opening/closing timings (valve timing) of intake valves and exhaust valves of an internal combustion engine (engine) in accordance with engine operating conditions.

2. Related Art

In a conventional valve timing adjusting apparatus for adjusting valve timing of intake valves and exhaust valves of an engine, as disclosed in JP-A 5-214907 or JP-U 2-50105, a driving force is transmitted from a crankshaft as a driving member of the engine to a camshaft as a driven member through a driving force transmitting mechanism. The driving force transmitting mechanism may be a vane type in which vanes are accommodated relatively rotatably in a housing and the rotational phase difference of the vanes relative to the housing is adjusted by the fluid pressure of operating fluid.

In the apparatus according to JP-A 5-214907, a housing comprises a circumferential wall and a pair of side walls covering axial side ends of the circumferential wall. This housing having three constructional parts causes the following drawbacks.

(1) A seal is necessitated at the joint surface between the circumferential wall and the side walls to restrict the leakage of an operating fluid, resulting in the increase in number of the parts and enlargement of the outer diameter of the housing by a groove for receiving the seal between the circumferential wall and the side walls.

(2) The centers of the bearing parts of the side walls of the housing deviates from each other due to variations in the machining precision and in the assembling precision of the parts.

In the apparatus according to JP-U 2-50105, as opposed to the above apparatus, a circumferential wall and a gear side wall which form a housing are made integrally. This housing does not cause the above drawbacks. In this integral type housing, however, the diameter of the gear side wall is determined by the diameter of the circumferential wall. As a result, the gear side wall cannot be reduced in radial size. Further, in the case the circumferential wall and one side wall is formed integrally, the inner angled corner between the circumferential wall and the side wall is smoothed causing low sealing ability thereat. Still further, the material for the housing is limited with respect to its rigidity, strength and the like.

In the case that a seal 112 is disposed in rotating sliding part between a vane 110 and a housing 111 as shown in FIG. 11 to seal a fluid pressure chamber to which the operating fluid is supplied to drive the vane 110, a wear step 111*a* is likely to be caused on the housing 111 if the seal 112 has a higher hardness (wear-causing characteristics) than the housing 111. The wear step 111*a* appears at positions where the seal 111 slides more often. When the seal 112 slides and reaches the wear step 111*a*, the seal 112 receives the fluid pressure in the arrow direction A from the side of the housing 111 and may be pushed into the side of the vane 110. This causes the leakage of the working fluid between the fluid pressure chambers provided on both circumferential sides of the vane 111 and it becomes hard to hold the vane 110 at the position shown in FIG. 11. This local wear of the housing will disable the vane to be controlled and held at the intermediate position. Though it is possible to restrict the wear of the housing by using a hard material such as an iron, such a material will increase the production cost and the weight of the housing.

SUMMARY OF THE INVENTION

It is therefore an object of the present invention to provide a rotational phase adjusting apparatus which obviates the above drawbacks.

It is another object of the present invention to provide a rotational phase adjusting apparatus which has a good sealing ability, less number of parts, less weight and can be made compactly.

According to the present invention, one side wall of a housing is fixed to one of a driving member and a driven member, while the other side wall of the housing is made integrally with a circumferential wall of the housing. A seal made of a material less harder than the housing is provided between the housing and a vane.

Preferably, the housing is made of an aluminum while the seal is made of a PPS resin, more preferably a PPS resin mixed with an inorganic filler.

Most preferably, the inorganic filler is harder than the PPS resin but less harder than the housing.

BRIEF DESCRIPTION OF THE DRAWINGS

Other objects, features and advantages of the present invention will become more apparent from the following detailed description when read with reference to the accompanying drawings, in which.

DETAILED DESCRIPTION OF THE PRESENTLY PREFERRED EMBODIMENT

A rotational phase adjusting apparatus according to the present invention will be described with reference to an embodiment which is used for adjusting opening/closing timings of the intake or exhaust valve of an internal combustion engine.

Figure 1:
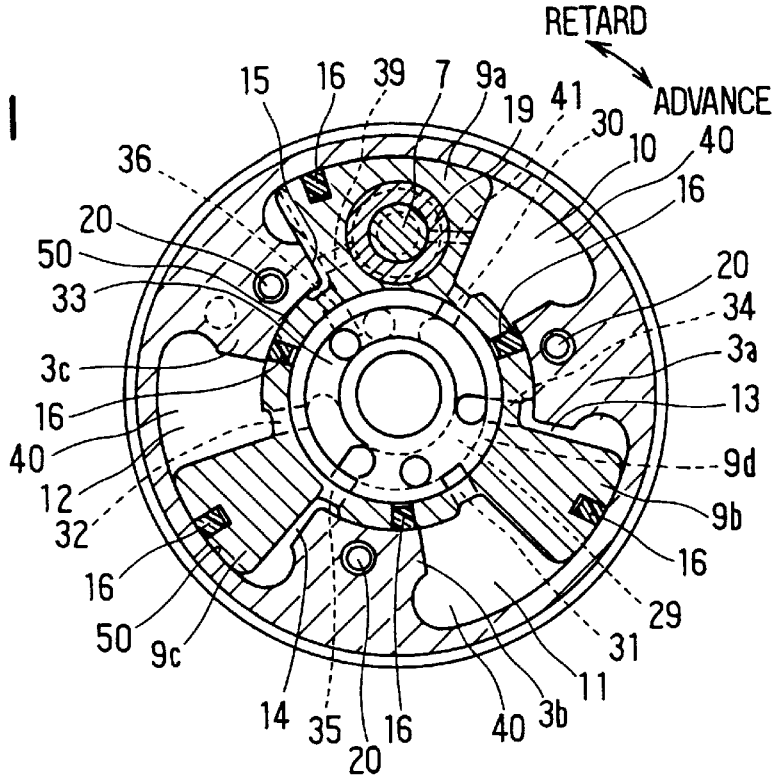
FIG. 1 is a front sectional view of a rotational phase adjusting apparatus according to an embodiment of the present invention.
Figure 2:
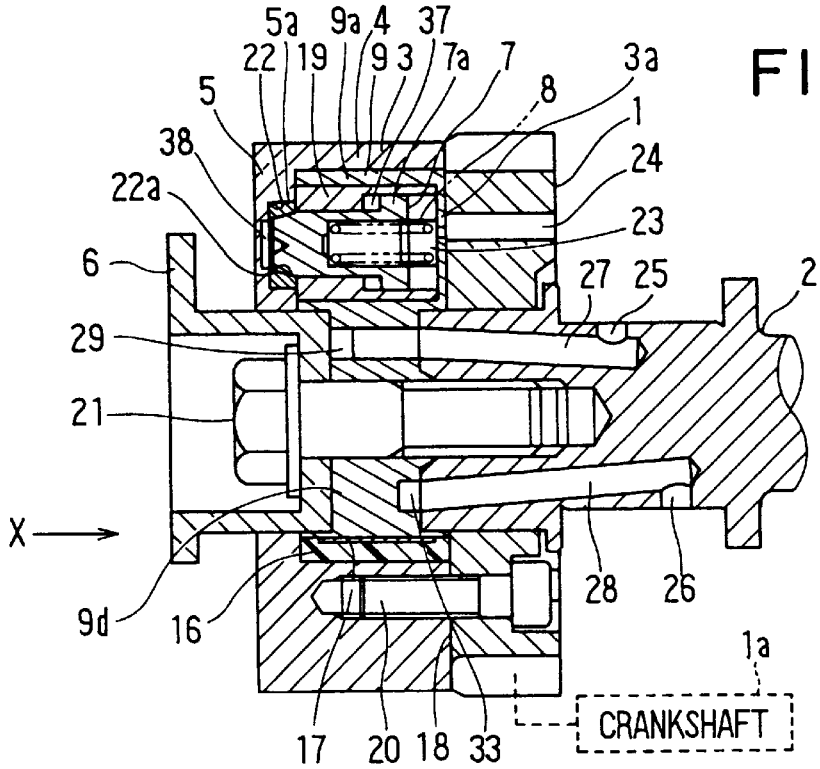
FIG. 2 is a side sectional view of the apparatus according to the embodiment.

As shown in FIGS. 1 and 2, a timing gear 1 is provided to receive a driving force from a crankshaft 1*a* of an engine (driving member) through a gear train (not shown) for synchronous rotation with the crankshaft 1*a*. A camshaft (driven member) 2 is provided to receive a driving force from the timing gear 1 to drive intake valves or exhaust valves (not shown) of the engine. The camshaft 2 is held turnably with a rotational phase difference relative to the timing gear 1. The timing gear 1 and the camshaft 2 are rotatable in the clockwise direction in FIG. 1 when viewed in the direction X in FIG. 2. This clockwise direction corresponds to an advance direction of valve opening/closing timing.

A rear plate 18 in the form of a thin ring plate is interposed between the timing gear 1 and a side wall of a cylindrical shoe housing 3 to restrict fluid leakage between the timing gear 1 and the shoe housing 3. The timing gear 1, shoe housing 3 and the rear plate 18 are arranged coaxially and fixed tightly by bolts 20 to constitute a housing unit and rotate together as a driving-side rotation body.

The shoe housing 3 comprises a circumferential wall 4 and a front plate 5 as a side wall, which are made integrally by aluminum die-casting. As the shoe housing 3 is made separately from the timing gear 1, the timing gear 1 may be made smaller in diameter than the shoe housing 3 if so desired. The shoe housing 3 has trapezoidal shoes 3*a*, 3*b* and 3*c* arranged circumferentially and spaced apart with a generally equal angular interval. Fan-shaped chambers 40 are provided as accommodating chambers for respective vanes 9*a*, 9*b* and 9*c* at three circumferential locations where spacings are provided between adjacent two of the shoes 3*a*, 3*b*, 3*c*. Each of the inside circumferential surfaces of the shoes 3*a*, 3*b* and 3*c* is formed arcuately in section.

A vane rotor 9 as a vane unit has the vanes 9*a*, 9*b* and 9*c* arranged circumferentially with an equal angular interval and accommodated turnably within the corresponding fan-shaped chambers 40 formed circumferentially between the adjacent two of the shoes 3*a*, 3*b* and 3*c*. The vane rotor 9 and a bushing 6 are fixed integrally with the camshaft 2 by a bolt 21 to provide driven-side rotation body. The bushing 6 fixed integrally with the vane rotor 9 is fitted into the inside wall of the front plate 5 relatively turnably against the front plate 5.

Figure 3:
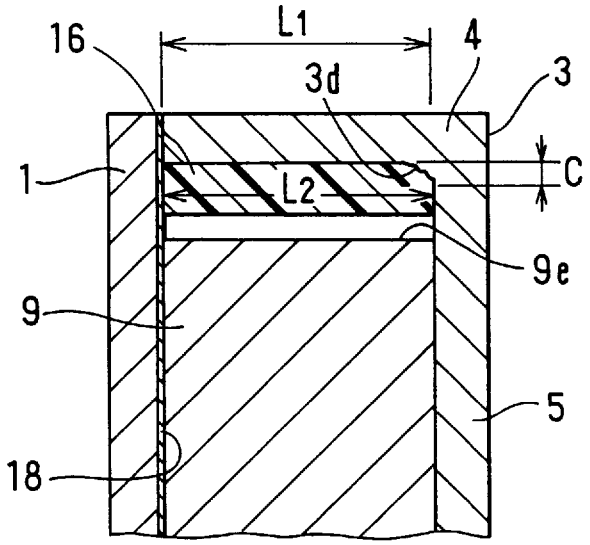
FIG. 3 is a schematic cross sectional view showing the arrangement of a seal used in the embodiment.

As shown in FIG. 3, an angled corner 3*d* of the inner wall surface of the housing 3 formed by the circumferential wall 4 and the front plate 5 is not at right angle but smoothed. This corner 3*d* will be necessarily caused by the wear of a die in the case of molding process or by the wear of a cutting tool in the case of cut-machining process. The axial length $L_1$ between the front plate 5 and the rear plate 18 is set to 22 through 25 mm.

Figure 4:
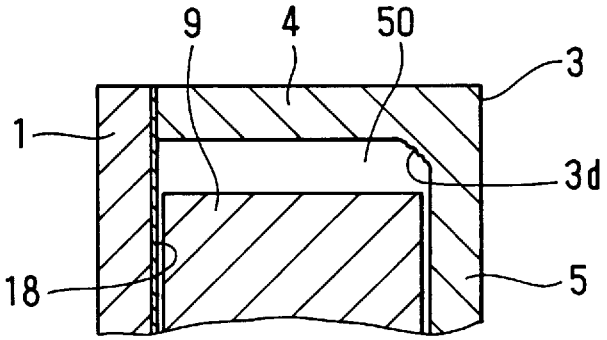
FIG. 4 is a schematic cross sectional view showing a clearance between a circumferential wall and a vane rotor in the embodiment.

A small clearances 50 are provided between the outer circumferential surfaces of the vane rotor 9 and the inner circumferential surfaces of the circumferential wall 4 as shown in FIG. 4 so that the vane rotor 9 and the shoe housing 3 are held relatively turnably. The magnitude of the clearance 50 is determined to eliminate the interference between the vane rotor 9 and the angled corner 3*d* and to align in position the radial centers of the shoe housing 3 and the vane rotor 9.

As shown in FIG. 3, the seal 16 is received in an axially extending groove 9*e* formed on the outer circumferential wall of the vanes 9*a*, 9*b* and 9*c* and in the outer circumferential wall of a boss 9*d* of the vane rotor 9 and are biased by respective springs 17 radially outwardly to restrict leakage of the operating fluid between fluid pressure chambers.

Figure 5:
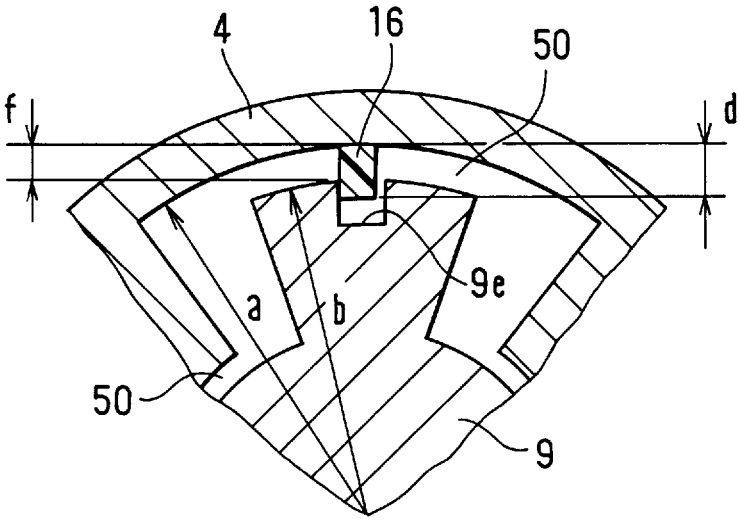
FIG. 5 is a schematic sectional view showing the operational state of the seal in the embodiment.

The seal 16 is made of a PPS (polyphenylene sulfide) resin as a base material and mixed with an inorganic filler which is harder than the PPS resin. The PPS resin is preferred because it has a good resistance to oils for less deterioration and is less likely to swell. Both the PPS resin and the inorganic filler are softer than the shoe housing (aluminum) 3. The seal 16 is biased by the leaf spring 17 and receives the centrifugal force radially outwardly toward the circumferential wall 4 so that the operating fluid leaks between the adjacent fluid pressure chambers through the clearance 50. The PPS resin for the base material of the seal 16 may be other resins such as PAI (polyamide imide), PI (polyimide), PEEK (polyether ether ketone), PET (polyethyleneterephthalete), PBT (polybuthylene terephthalete), PEN (polyethylene naphthalete), PA (polyamide), POM (polyoxymethylene), phenol and Teflon. The axial length $L_2$ of the seal 16 is set to be shorter than $L_1$. In addition, the protrusion f of the seal 16 (FIG. 5) from the vane rotor 9, that is, the magnitude of the clearance 50, is determined as follows with a being the inner radius of the shoe housing 3, b being the outer radius of the vane rotor 9 and c being the radial length of the angled corner of the inner wall (FIG. 4).

$f=a-b>c+$(radial deviation between the centers of the housing 3 and the vane rotor 9)

Figure 6:
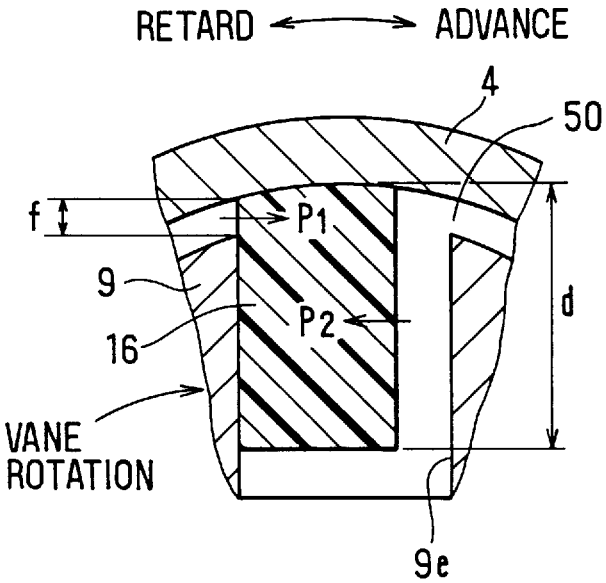
FIG. 6 is a partial enlarged view of FIG. 5.

In FIG. 6, P1 and P2 denote operating fluid pressures which the seal 16 receives from an advancing-side fluid pressure chamber 13, 14 or 15 and from the retarding-side fluid pressure chamber 10, 11 or 12, respectively, and d denotes the radial thickness of the seal 16.

The retarding-side fluid pressure chambers 10, 11 and 12 are defined between the shoe 3*a* and the vane 9*a*, between the shoe 3*b* and the vane 9*b* and between the shoe 3*c* and the vane 9*c*, respectively. The advancing-side fluid pressure chamber 13, 14 and 15 are defined between the shoe 3*a* and the vane 9*b*, between the shoe 3*b* and the vane 9*c* and between the shoe 3*c* and the vane 9*a*, respectively.

According to the above construction, the camshaft 2 and the vane rotor 9 are enabled to turn coaxially and relatively against the shoe housing 3 and the timing gear 1.

A guide ring 19 is pressed into the inner wall of the vane 9*a* having an accommodating hole 23 and a stopper piston 7 is thus accommodated within the vane 9*a* slidably in the axial direction of the camshaft 2 while being biased toward the front plate 5 by a spring 8. A stopper hole 5*a* is formed in the front plate 5 and a guide ring 22 having a tapered hole 22*a* is press-fitted into the stopper hole 5*a*. The stopper piston 7 receiving the biasing force of the spring 8 is movable into the tapered hole 22*a*. A communication passage 24 formed in the timing gear 1 is in communication with the accommodating hole 23 at the right side in FIG. 2 and open to the atmosphere so that the stopper piston 7 is not restricted from moving axially.

A fluid pressure chamber 37 at the left side of the flange 7*a* in FIG. 2 is in communication with the advancing-side fluid pressure chamber 15 through a fluid passage 39. With the operating fluid being supplied into the advancing-side fluid pressure chamber 15, the stopper piston 7 moves out from the tapered hole 22*a* against the biasing force of the spring 8. A fluid pressure chamber 38 formed at the top side of the stopper piston 7 is in communication with the retarding-side fluid pressure chamber 10 through a fluid passage 41 shown in FIG. 1. With the operating fluid being supplied into the retarding-side fluid pressure chamber 10, the stopper piston 7 moves out from the tapered hole 22*a* against the biasing force of the spring 8.

The positions of the stopper piston 7 and the tapered hole 22*a* are so determined that the stopper piston 7 is fitted into the tapered hole 22*a* when the camshaft 2 is at the most retarded position against the crankshaft 1*a*, that is, when the vane rotor 9 is at the most retarded position against the shoe housing 3. Thus, the stopper piston 7 and the tapered hole 22*a* provides a lock mechanism.

The boss 9*d* of the vane rotor 9 has a fluid passage 29 at a position where it abuts axial end of the busing 5 and a fluid passage 33 at a position where it abuts the axial end of the camshaft 2. The fluid passages 29 and 33 are formed arcuately. The fluid passage 29 is in communication with a fluid source or drain (not shown) through fluid passages 25 and 27. Further, the fluid passage 29 is in communication with the retarding-side fluid pressure chambers 10, 11 and 12 through fluid passages 30, 31 and 32 and in communication with the fluid pressure chamber 38 through a fluid passage 41.

The fluid passage 33 is in communication with the fluid source or drain (not shown) through fluid passages 26 and 28. Further, the fluid passage 33 is in communication with the advancing-side fluid pressure chambers 13, 14 and 15 through fluid passages 34, 35 and 36 and in communication with the fluid pressure chamber 37 through the advancing-side fluid pressure chamber 15 and a fluid passage 39.

The above rotational phase adjusting apparatus operates as follow.

As known in the art, during normal engine operation, the stopper piston 7 is kept out of the tapered hole 22*a* by the operating fluid supplied to the retarding-side fluid pressure chambers 10, 11, 12 and the advancing-side fluid pressure chambers 13, 14, 15 so that the vane rotor is rotatable relative to the shoe housing 3. the valve opening/closing timing, that is, the rotational phase difference between the crankshaft 1a and the camshaft 2 is controlled by the adjustment of the fluid pressure supplied to the fluid pressure chambers 10 through 15.

When the engine stops, the operating fluid is not supplied to the retarding-side fluid pressure chambers 10, 11, 12 and the advancing-side fluid pressure chambers 13, 14, 15 so that the vane rotor 9 stops at the most retarded position relative to the shoe housing 3 as shown in FIG. 1. As the operating fluid is not supplied to the fluid pressure chambers 37 and 38 either, the stopper piston 7 fits into the tapered hole 22*a* by the biasing force of the spring 8.

Even after the engine restarting, the stopper piston 7 is held fitted in the tapered hole 22*a* until the operating fluid is supplied to the fluid pressure chambers 10 through 15, so that the camshaft 2 is maintained at the most retarded angular position against the crankshaft 1*a*. Thus, during the period before the operating fluid is supplied to each fluid pressure chamber, the vane rotor 9 is locked to the front plate 5 to prevent the shoe housing 3 and the vane rotor 9 from hitting each other because of changes in the torque of the cam.

As the operating fluid is supplied to the retarding-side fluid pressure chambers 10, 11, 12 or the advancing-side fluid pressure chambers 13, 14, 15, it is also supplied to the fluid pressure chambers 37 or 38. The stopper piston 7, receiving the fluid pressure in the right direction in FIG. 2, moves out from the tapered hole 22*a* against the biasing force of the spring 8. As the front plate 5 and the vane rotor 9 is thus released from the locked condition, the vane rotor 9 is enabled to turn relatively against the shoe housing 3 in response to the pressure of operating fluid supplied to the retarding-side fluid pressure chambers 10, 11, 12 and the advancing-side fluid pressure chambers 13, 14, 15. Thus, the relative rotational or angular phase of the camshaft 2 against the crankshaft 1*a* is adjusted.

Figure 7A:
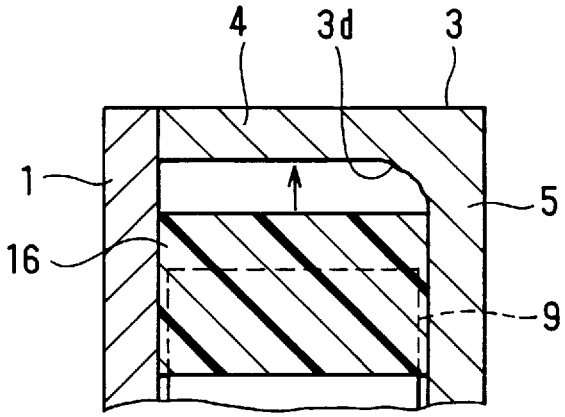
FIGS. 7A through 7C are schematic cross sectional views showing progress of wear of the seal.
Figure 7B:
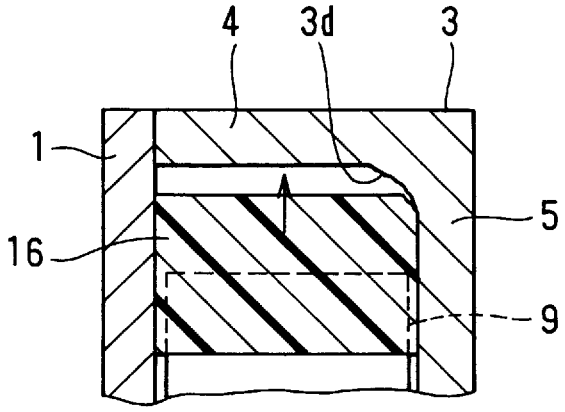
Figure 7C:
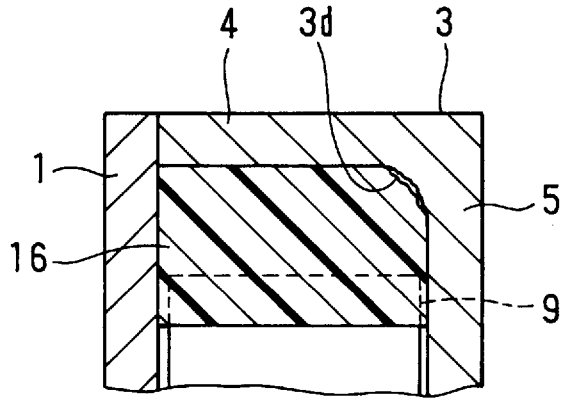

The seal 16 wears progressively as shown in FIGS. 7A through 7C.

In the initial state (FIG. 7A) in which the seal 16 is fitted first in the vane rotor 9 (more particularly in the groove 9*e*), the corners of the seal 16 are all at right angle. Though the seal 16 is held biased in the arrow direction by the biasing force of the leaf spring 17 and the centrifugal force, the top end of the seal 16 is stopped by the angled corner 3*d* and restricted from contacting the inner wall of the shoe housing 3 (circumferential wall 4) and therefore the force concentrates on the angled corner of the seal 16 which slides over the inner angled corner 3*d*. As the seal 16 is made of a material softer than the shoe housing 3, the angled corner (shoulder) of the seal 16 tends to wear as shown in FIG. 7B as the vane rotor 9 moves reciprocally allowing the seal 16 to move closer to the inner wall of the shoe housing 3. As the wear of the seal 16 progresses and the seal 16 contacts the inner wall of the shoe housing 3 for sliding movement, the force does not concentrate on the angled corner of the seal 16. The initial local wear of the seal 16 ends thus, and the wear progresses on the entire top end of the seal 16.

When the seal 16 wears so that the shape of its angled corner agrees to the shape of the inner angled corner 3*d* of the shoe housing 3, the radial clearance between the circumferential wall 4 and the seal 16 disappears. As a result, the seal 16 assuredly restricts the leakage of operating fluids between the advancing-side and the retarding-side fluid pressure chambers.

As described above, the wear seal 16 is made of PPS mixed with a filler and the housing 3 is made of aluminum. The wear of resin and aluminum was measured with respect to various fillers as shown in FIG. 8B. In this measurement or testing, a barbell 101 made of PPS resin as a base material is placed on an aluminum plate 100 and the aluminum plate 100 is rotated at a constant speed (V=0.5 m/s) with a constant pressure (P=0.5 kgf/mm$^2$) being applied to the barbell 101.

Figure 8A:
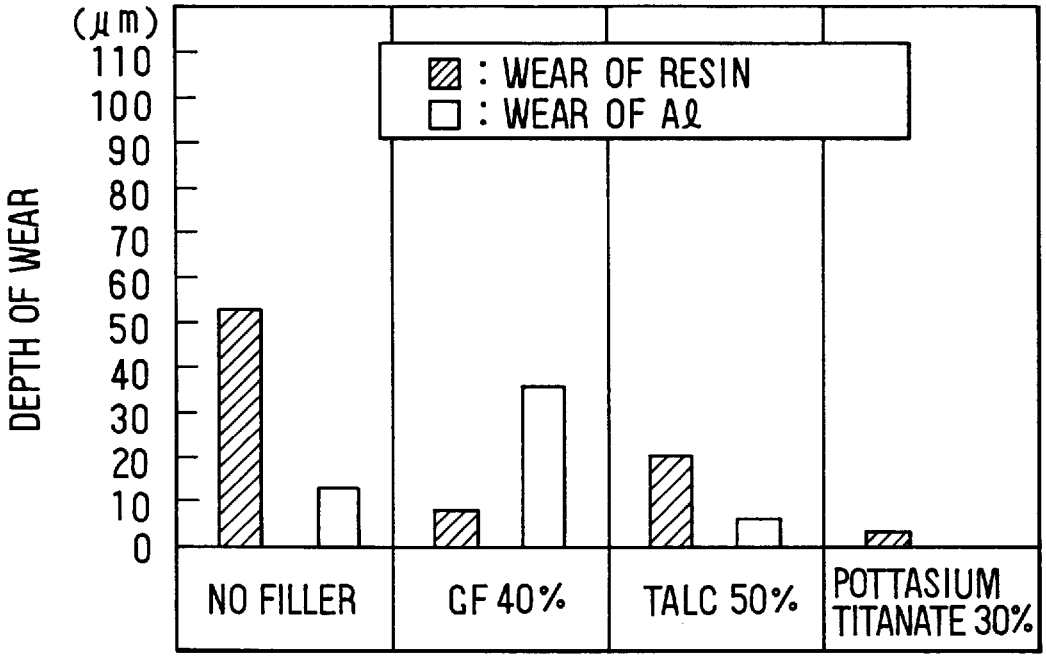
FIG. 8A is a characteristic graph showing the relation between a filler used in the seal and the wear.
Figure 8B:
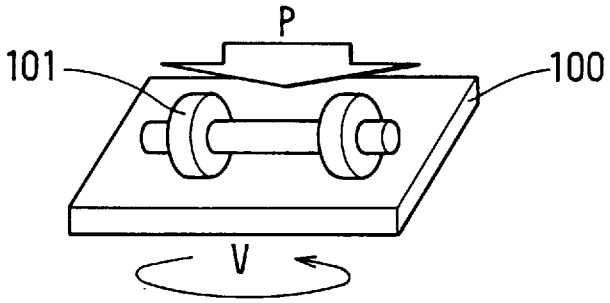
FIG. 8B is a schematic view showing a test system for measuring the wear.

The measurement result is shown in FIG. 8A. It is understood that, in the case the barbell 101 is made of the PPS resin only without any filler, the aluminum plate 100 wears comparatively less while the barbell 101 wears greatly because of its PPS resin which is rather soft. Although the PPS resin is soft, the aluminum plate 100 wears more than the cases of the PPS resin mixed with talc or potassium titanate which is in a small needle shape. This results from the fact that the aluminum powder produced by the wear of the aluminum plate 100 is impregnated into the barbell 101 made of soft PPS resin and the impregnated aluminum powder causes the wear on the aluminum plate 100. Though the wear of PPS resin mixed with no filler is larger than that of wear of PPS mixed with talc or pottasium titanate which is harder than PPS resin, it can be used for the seal 16.

In the case of PPS resin mixed with GF (glass fiber) having a higher hardness between 7 through 8, the barbell 101 wears less while the aluminum plate 100 wears more. That is, as GF is harder than aluminum and causes the wear on the aluminum, it may not be suitable for mixing into PPS resin for the seal 16. However, as GF is mixed into the PPS resin for the seal 16, the coefficient of linear expansion of the seal 16 will become closer to that of the shoe housing 3 so that sealing performance may be improved. For this reason, GF can be used as the filler as well.

In the case of PPS resin mixed with the talc by 50% or the pottasium titanate by 30%, the wear of both the aluminum plate 100 and the barbell was small. From the measurement of wear, it was ascertained that mixing the PPS resin with an inorganic filler having a certain hardness is advantageous for producing the seal 16. The talc and pottasium titanate has respective Mohs hardness 2 and 4. As long as a material is harder than the PPS resin but has a Mohs harness less than 5, any other material than the talc and pottasium titanate may be used as the inorganic filler for the seal 16. For instance, clay (hardness 2), mica (hardness 3), aluminum hydroxide (hardness 3), graphite (hardness 1–2) or zinc oxide (hardness 4.2) may be used. Carbon fiber (harness 1–2) may also be used alternatively to the inorganic filler. Those fillers do not drop from the outer surface of the seal 16 to form cavities when sliding on the iron or aluminum, but rather the filler wears and the wear powder discharges externally the aluminum powder or foreign matters together therewith. The mixing percentage of the inorganic filler is preferably between 5% and 70% in weight of the materials for the seal 16. This is because that the mixing percentage of less than 5% does not provide satisfactory sliding with the shoe housing 3, while the mixing percentage of more than 70% makes the mixing with PPS resin difficult and lowers the material flow during an injection molding. Most preferably, the mixing percentage is between 30% and 60%. This mixing percentage is preferred in the case of aluminum housing so that the seal has a coefficient of linear expansion which is close to that of aluminum. A good sealing performance can be provided in a wide temperature range, e.g., between −40° C. and 150° C.

With the reduced difference between the coefficients of linear expansion of the shoe housing and the seal 16, the axial clearance between the shoe housing 16 and the shoe housing 3 will not change even when the seal 16 and the shoe housing 3 repeat expansion and contraction. Thus, the leakage of fluid will not increase and the seal 16 is enabled to slide on the inner wall surface of the shoe housing 3 with the unchanged contact force. As a result, the seal will not wear excessively and the working fluid will not leak between the fluid pressure chambers. As described above, GF (glass fiber) may be mixed as a filler in the seal 16 for the reduction in the difference of coefficients of linear expansion of the seal and the shoe housing 3.

The filler materials which are less likely to cause wear of the shoe housing 3 are talc, clay, potassium titanate in needle shape, carbon fiber, graphite and zinc oxide in needle shape.

Though Teflon resin has no effect to reduce the difference of the coefficient of linear expansion of the seal 16 from that of the shoe housing 3, the seal 16 can be made to cause less wear of the shoe housing 3 by mixing the powder of Teflon resin with the base material such as PPS resin. The mixture of the powder of Teflon resin and the above filler reduces the difference in the coefficient of the linear expansion between the seal 16 and the shoe housing 3 and the wear of the shoe housing 3.

Figure 9:
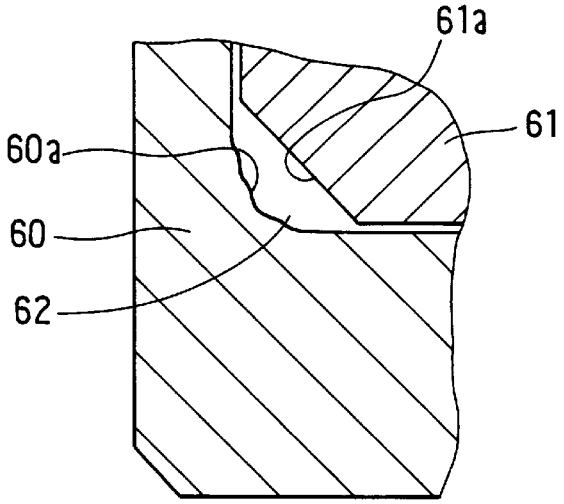
FIG. 9 is a schematic sectional view showing a comparative arrangement of a seal.

In a comparative example shown in FIG. 9, a vane rotor 61 has no seal and is constructed to slide directly over the inner wall surface of a shoe housing 60. The shoe housing 60 has its circumferential wall and one side wall formed integrally, thus forming an inner smoothed angled corner 60*a* as in the above embodiment. The vane rotor 61 has a chamfered corner 61*a* to avoid interference with the smoothed angled corner 60*a*. The chamfered corner 61*a* thus provides a clearance 62. As this clearance 62 allows the working fluid to leak therethrough, the fluid pressure in the fluid pressure chambers is likely to reduce and lowers the response characteristics of the valve timing control. Further, the shoe housing 60 and the vane rotor 61 must be machined with high precision in the radial direction to cope with the direct sliding contact between the shoe housing 60 and the vane rotor 61. Still further, the direct sliding will cause wear of the sliding surfaces of the shoe housing 60 and the vane rotor 61 and cause clearances or recesses on the sliding surfaces. This will also lead to the fluid leakage and the lowered response characteristics of the valve timing control.

Contrary to the comparative example, the seal 16 of the present embodiment is constructed to wear so that the shape of the angled corner of the seal 16 agrees to the shape of the inner angled corner of the shoe housing 3. As a result, no clearances will be formed by the sliding contact. Further, as the seal is softer than the shoe housing 16, the wear of the circumferential wall 4 caused by the sliding contact with the seal 16 is reduced. Thus, the local wear of the circumferential wall 4 caused on the surfaces where the seal 16 repeats to reciprocate is reduced to restrict the fluid leakage. In addition, as the fluid leakage does not occur at specified places locally, the vane rotor 9 can be held assuredly at the desired angular position. As the vane rotor 9 does not slide over the shoe housing 3 directly in the radial direction, machining the shoe housing 3 in the radial direction can be simplified and the sliding wear of the shoe housing 3 and the seal 16 can be prevented even in the case both are made of metals.

Figure 10:
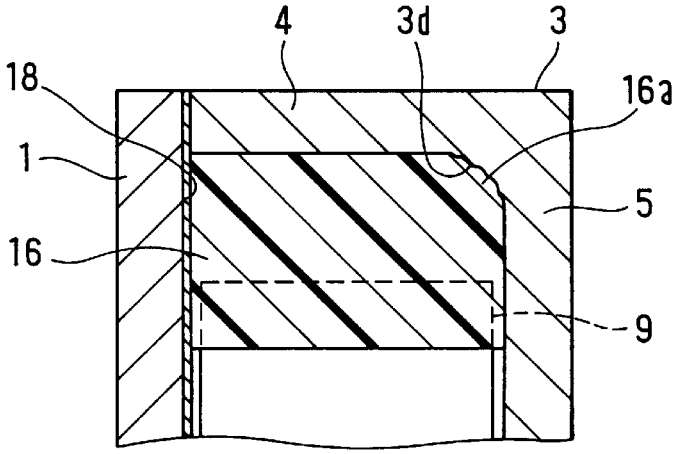
FIG. 10 is a schematic view showing a modification of the embodiment.
Figure 11:
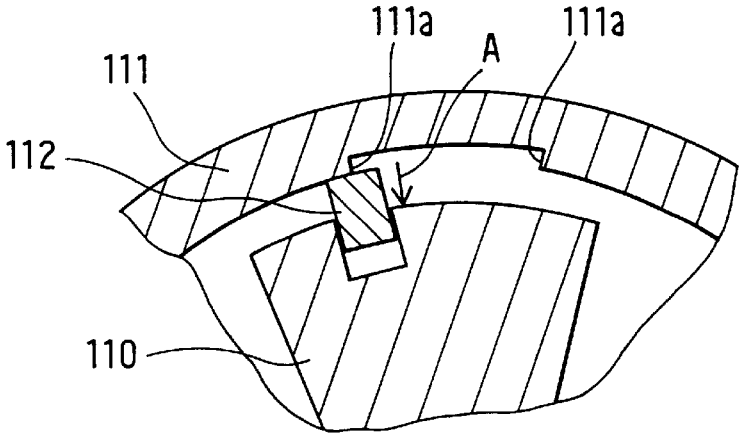
FIG. 11 PRIOR ART
FIG. 11 is a front sectional view showing partly a conventional apparatus.

The above embodiment may be modified as shown in FIG. 10. That is, the seal 16 may be formed to have a small chamfered corner 16*a* on its one shoulder in correspondence with the inner smoothed angled corner 3*d* of the shoe housing 3. This will enable the seal 16 to contact with the circumferential wall 4 at its top end even at the very first time of its fitting with the vane rotor 9 without waiting the angled corner of the vane rotor 9 to wear. The similar chamfered corner may be formed on the other shoulder which is located at the joint between the circumferential wall 4 and the rear plate 18. In this case, assembling the vane rotor 9 in the shoe housing 3 can be simplified because one of the chamfered corners 16*a* can be positioned to correspond the inner smoothed angled corner 3*d* even when the vane rotor 9 is assembled reversely in the axial direction.

In the above embodiment, as the shoe housing 3 is made separately from the timing gear 1, the radial size of the timing gear 1 can be set separately from the shoe housing 3. As the seal 16 is made of the PPS resin softer than the shoe housing 3 and the PPS resin is mixed with the filler of Mohs hardness less than 5 which is harder than the PPS resin but softer than the shoe housing 3, the shoe housing 3 can be made of aluminum which is light and is machined easily.

As the powder of aluminum of the shoe housing 3 caused by the sliding and the powder of iron mixed in the working fluid will be discharged together with the powder of wear of the inorganic filler, the sliding surface of the shoe housing 3 will not wear by such powders.

In the case of aluminum shoe housing, the seal may be made of rubber as the base material. In the case of forming the shoe housing by a sintered metal such as iron, the seal may be made of aluminum, resin, or rubber.

The above embodiment may be modified further without departing from the spirit and scope of the present invention.

We claim:

1. A rotational phase adjusting apparatus for adjusting a rotational phase between a driving member and a driven member, the apparatus comprising:

a housing disposed in a driving force transmitting system which transmits a driving force from the driving member to the driven member and rotatable with one of the driving member and the driven member, the housing having a circumferential wall and a pair of axial side walls, the circumferential wall having therein a chamber, and one of the axial side walls being formed integrally with the circumferential wall;

a vane rotatable with the other of the driving member and the driven member and accommodated in the chamber and movable relative to the housing in response to an operating fluid supplied to the chamber; and a seal fitted on the vane to slide over a surface of the housing and having a hardness less than that of the housing;

wherein the seal includes a resin as a base material.

2. The rotational phase adjusting apparatus according to claim 1, wherein the housing includes an aluminum material.

3. The rotational phase adjusting apparatus according to claim 1, wherein the driving member and the driven member are a crankshaft and a camshaft of an internal combustion engine.

4. The rotational phase adjusting apparatus according to claim 1, wherein the resin is a polyphenylene sulfide (PPS).

5. The rotational phase adjusting apparatus according to claim 1, wherein the seal further includes a filler harder than the PPS resin and having a Mohs hardness less than 5.

6. The rotational phase adjusting apparatus according to claim 5, wherein the filler is inorganic.

7. The rotational phase adjusting apparatus according to claim 6, wherein the inorganic filler is mixed with the PPS resin by 30% through 60% in weight.

8. The rotational phase adjusting apparatus according to claim 1, wherein the resin is an oil-resisting type.

9. The rotational phase adjusting apparatus according to claim 1, wherein the seal has a coefficient of linear expansion which is close to that of the housing.

10. The rotational phase adjusting apparatus according to claim 1, wherein the seal has a chamfered corner which corresponds to the shape of an inner angled corner of a joint between the circumferential wall and the one axial side wall.

11. A rotational phase adjusting apparatus for an internal combustion engine for adjusting a rotational phase between a driving member and a driven member, the apparatus comprising:

a force transmitting member coupled with one of the driving member and the driven member;

a housing disposed rotatably with the force transmitting member and having a circumferential wall and a pair of axial side walls, the circumferential wall having therein a chamber, one of the axial side walls being formed integrally with the circumferential wall and separately from the force transmitting member, and the other of the axial side walls being formed separately from the circumferential wall and fixed to the force transmitting member;

a vane rotatable with the other of the driving member and the driven member and accommodated in the chamber and movable relative to the housing in response to an operating fluid supplied to the chambers; and a seal fitted on the vane to slide over a surface of the housing and having a hardness less than that of the housing the seal including a resin filled with a filler which is less wear-aggressive to the housing.

* * * * *

UNITED STATES PATENT AND TRADEMARK OFFICE

CERTIFICATE OF CORRECTION

PATENT NO. : 5,875,750
DATED : March 2, 1999
INVENTOR(S) : IWASAKI et al

It is certified that error appears in the above-identified patent and that said Letters Patent is hereby corrected as shown below:

On the title page, item [54] and Column 1, lines 1-2, the title should read

--ROTATIONAL PHASE ADJUSTING APPARATUS HAVING RESIN SEAL--

Signed and Sealed this

Sixth Day of July, 1999

*Attest:*

Q. TODD DICKINSON

*Attesting Officer*

*Acting Commissioner of Patents and Trademarks*